US006992426B2

(12) United States Patent
Francesconi et al.

(10) Patent No.: US 6,992,426 B2
(45) Date of Patent: Jan. 31, 2006

(54) SPARK PLUG OF AN INTERNAL COMBUSTION ENGINE

(75) Inventors: Christian Francesconi, Bruck a.d.Mur (AT); Christoph Egger, Jenbach (AT)

(73) Assignee: Jenbacher Aktiengesellschaft, (AT)

( * ) Notice: Subject to any disclaimer, the term of this patent is extended or adjusted under 35 U.S.C. 154(b) by 0 days.

(21) Appl. No.: 10/164,045

(22) Filed: Jun. 5, 2002

(65) Prior Publication Data

US 2004/0070323 A1 Apr. 15, 2004

(30) Foreign Application Priority Data

Jun. 5, 2001 (AT) ..... A 867/2001

(51) Int. Cl.
*H01T 13/22* (2006.01)

(52) U.S. Cl. ..... 313/144; 313/135

(58) Field of Classification Search ..... 313/118, 313/135, 141, 144, 145, 140; 123/169 R, 123/169 EL, 169 P
See application file for complete search history.

(56) References Cited

U.S. PATENT DOCUMENTS

| | | | | |
|---|---|---|---|---|
| 1,662,878 A | | 3/1928 | Barcus | 174/152 S |
| 2,941,363 A | | 6/1960 | Cuny et al. | 60/39.827 |
| 3,825,784 A | * | 7/1974 | Lindsay | 313/11.5 |
| 4,489,596 A | * | 12/1984 | Linder et al. | 73/116 |
| 4,490,122 A | * | 12/1984 | Tromeur | 445/7 |
| 5,014,656 A | * | 5/1991 | Leptich et al. | 123/169 EL |
| 5,430,346 A | * | 7/1995 | Johnson | 313/139 |
| 5,918,571 A | | 7/1999 | Below | 123/169 R |
| 6,152,095 A | | 11/2000 | Ripma et al. | 123/169 R |

FOREIGN PATENT DOCUMENTS

| | | |
|---|---|---|
| CH | 0 859 436 A1 | 2/1998 |
| DE | 1919828 | 2/1926 |
| DE | 609 353 C | 2/1935 |
| DE | 196 41 856 A1 | 4/1997 |
| GB | 156087 | 11/1920 |
| GB | 247491 | 2/1926 |
| GB | 2 249 345 A | 5/1992 |
| GB | 1 049 222 A1 | 4/2000 |
| JP | 0 834 973 A2 | 9/1997 |
| WO | WO 95/25372 | 9/1995 |

OTHER PUBLICATIONS

European Search Report from the European Patent Office dated Aug. 20, 2002 (w/English language version), E. Bijn-Examiner. For App. EP02010192.

* cited by examiner

*Primary Examiner*—Thuy Vinh Tran
(74) *Attorney, Agent, or Firm*—Lorusso & Associates

(57) ABSTRACT

A spark plug of an internal combustion engine, in particular for use in Otto-cycle gas engines, having an insulator body, at least one fixed ground electrode carrier arrangement and at least one fixed central electrode carrier, wherein a spark plug housing having at least two parts encloses the insulator body, wherein the spark plug housing has a lower housing portion and an upper housing portion, wherein at least the combustion chamber-side part of the insulator body is pressure-resistantly, preferably completely, enclosed by the lower housing portion jointly with the upper housing portion.

26 Claims, 1 Drawing Sheet

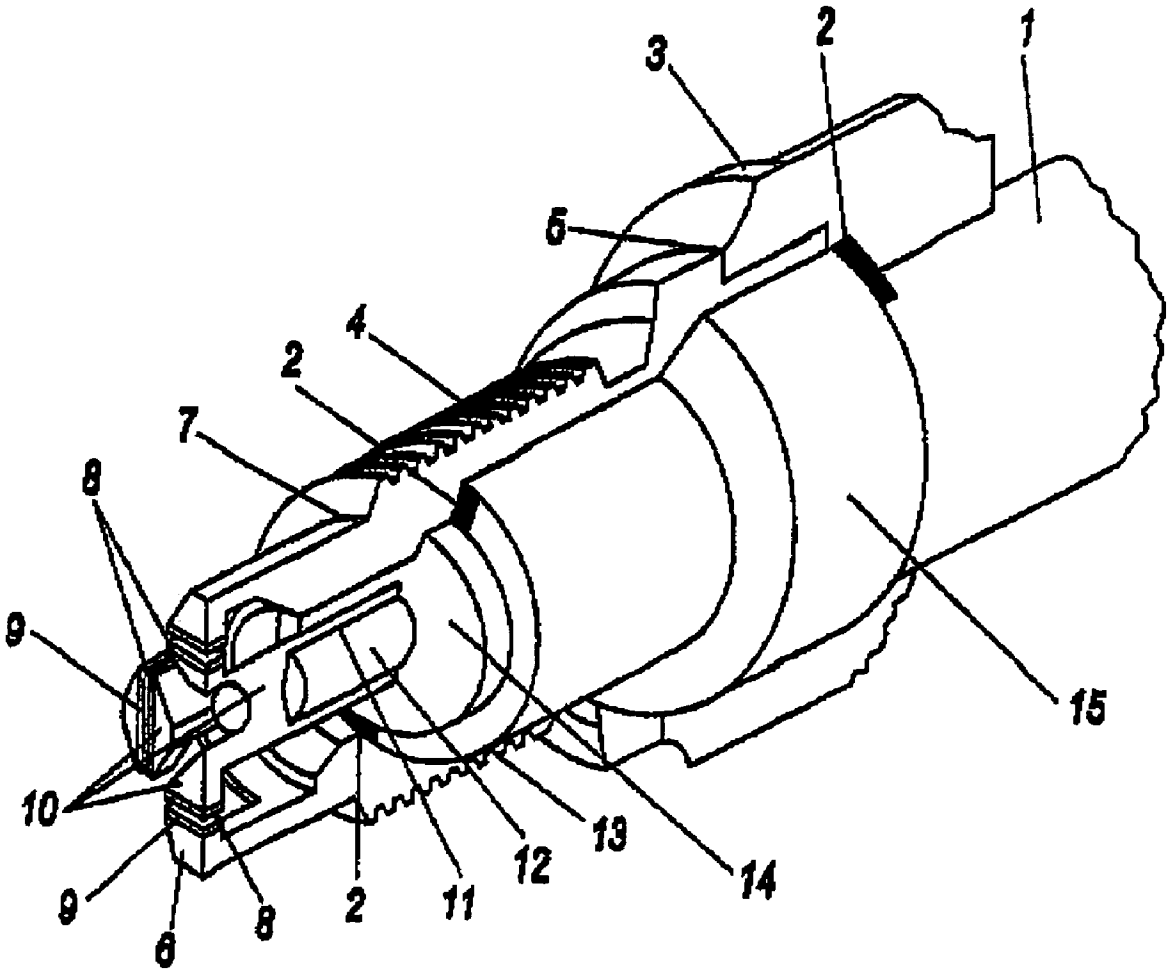
1
2
3
5
4
2
7
8
9
9
10
9
8
6
2
11
12
13
14
15

SPARK PLUG OF AN INTERNAL COMBUSTION ENGINE

BACKGROUND OF THE INVENTION

The present invention concerns a spark plug of an internal combustion engine, in particular for use in Otto-cycle gas engines, comprising an insulator body, at least one fixed ground electrode carrier arrangement and at least one fixed central electrode carrier, wherein a spark plug housing having at least two parts encloses the insulator body.

The spark plugs available at the present time for industrial gas engines are in many cases products which were derived from the automobile industry and adapted by suitable improvements for the preferential use in industrial gas engines. Those spark plugs generally have a fixed cylindrical central electrode provided with a precious metal pin. In the case of the fixed ground electrodes, both a hook electrode and also between two and four laterally disposed electrode fingers are used. Such ground electrodes can also be provided with a precious metal plate portion. Spark plugs of that kind are known from EP 0 834 973 A2, EP 0 859 436 A1, EP 1 049 222 A1, DE 196 41 856 A1 and WO 95/25372. Spark plugs of the general kind set forth, with multi-part spark plug housings, are known for example from GB 156 087 A or U.S. Pat. No. 6,152,095 A. A major disadvantage of the spark plugs known from the state of the art is that their resistance to pressure is not sufficiently good for on-going operation. It thus frequently happens in the case of spark plugs in accordance with the state of the art that the insulator body or the base central electrode is unintentionally expelled. If this happens under operating conditions in which a high internal pressure obtains in the cylinder of the internal combustion engine, that can involve explosive expulsion of the insulator body and/or the base central electrode in the case of spark plugs in accordance with the state of the art, which inter alia can also represent a danger to operating personnel present.

SUMMARY OF THE INVENTION

Therefore the object of the invention is to provide a spark plug in which the disadvantages of the spark plugs in accordance with the state of the art are eliminated. The invention further seeks to provide a process for producing the spark plugs according to the invention.

In accordance with the invention that is achieved in that the spark plug housing has a lower housing portion and an upper housing portion, wherein at least the combustion chamber-side part of the insulator body is pressure-resistantly, preferably completely, enclosed by the lower housing portion jointly with the upper housing portion.

By virtue of the configuration according to the invention of the spark plug housing with a lower housing portion and an upper housing portion, the individual parts can be produced in a highly pressure-resistant manner, then pushed onto the insulator body and thus assembled in such a way as to afford a very pressure-resistant spark plug.

In that case, the assembly of the lower housing portion and the upper housing portion encloses the insulator body of the spark plug in such a way that unwanted expulsion of the insulator body or the base central electrode from the spark plug housing constructed in that fashion is effectively prevented. The terms lower housing portion and upper housing portion relate to the normal position of installation of a spark plug, in which the lower housing portion faces downwardly in the direction of the combustion chamber and the upper housing portion faces upwardly in the direction of the spark plug cap.

In regard to the joining of the individual parts of the spark plug housing it is particularly desirable if they are pushed one over the other and/or pressed together and/or welded together in their contact region. That form of connection in the contact region between the individual parts of the spark plug housing produces a particularly pressure-resistant spark plug.

For the purposes of fastening the spark plug in the cylinder, it is particularly desirable for at least a part of the spark plug housing to have a screwthread for screwing into a cylinder head.

Advantageous embodiments provide that the individual parts of the spark plug housing are made from electrically conductive material and/or the joins between the individual parts of the spark plug housing are adapted to be conductive in their respective contact region. In that way the spark plug housing can be used as an electrically conductive connecting portion between at least one ground electrode and the cylinder or engine block.

Advantageous variants provide that the individual parts of the spark plug housing preferably each have at least one seal in relation to the insulator body. Such seals prevent the issue of gas or a drop in pressure through the spark plug.

The pressure-resistance of the spark plug is further increased in particularly preferred embodiments in that the insulator body has at least one bead or ridge which preferably extends over its entire periphery and which is preferably arranged in at least one contact region of at least two housing parts.

Advantageous alternative embodiments of the multi-part and electrically conducting spark plug housing provide that the ground electrode carrier arrangement is disposed on the spark plug housing and has at least one ground electrode. In this case the term ground electrode carrier arrangement relates to an arrangement of at least one ground electrode carrier on which in turn at least one ground electrode is disposed.

In order to ensure a long service life for the spark plug, individual preferred embodiments provide that the ground electrode carrier arrangement has preferably four, mutually perpendicularly arranged, flat, preferably inwardly facing ground electrodes. In that respect it is in turn desirable for at least one ground electrode and/or at least one ground electrode carrier arrangement to be welded to at least a part of the spark plug housing and/or integrated into at least a part of the housing.

In the case of the central electrode carrier which is formed as a counterpart to the ground electrodes and the ground electrode carrier arrangement, it is particularly desirable if at least one central electrode and preferably four central electrodes, which are mutually perpendicularly arranged and which are flat and which preferably face outwardly, is or are arranged on the central electrode carrier. In this case the central electrode carrier, like also the ground electrode carrier arrangement, can have one or more individual electrode carriers and electrodes. It is particularly desirable if the electrodes of the central electrode carrier and the ground electrode carrier arrangement are respectively arranged in pairs in oppositely disposed plane-parallel relationship, having an insulating air gap between each other. Such an arrangement provides for very good reliable ignition of the fuel-air mixture and also provides for a long service life for the pressure-resistance spark plug.

A particularly pressure-resistant variant provides that the central electrode carrier is shouldered on the insulator body and/or surrounds the base central electrode and/or is preferably completely welded to the base central electrode. That prevents in particular unwanted expulsion of the base central electrode from the spark plug.

To provide a long service life for the spark plug, particularly desirable alternative configurations provide that the edge length of the central electrodes and/or the ground electrodes is greater than 4 mm, preferably greater than 6 mm. A further improvement in the service life of the electrodes is achieved if the electrodes of the central electrode carrier arrangement have a coating of precious metal and/or precious metal plate portion.

To produce such a spark plug, a desirable process provides that the individual parts of the spark plug housing are produced individually, pushed over a commercial standard insulator body and/or pushed over each other and/or pressed and/or welded to each other. That makes it possible to use a standard insulator body for production of a spark plug according to the invention, which markedly reduces the production costs for such a spark plug. It is moreover particularly advantageous if the central electrode carrier is produced to start with, pushed flush onto a base central electrode of the insulator body as far as the insulator base, and welded.

Further advantageous embodiments provide that the ground electrode carrier arrangement is welded to at least a part of the spark plug housing or produced integrated into at least a part of the spark plug housing, and that the welding operation is effected by using a pulsed and/or continuously operating laser welding process and/or electrode beam welding process and/or plasma welding process and/or high-vacuum brazing process and/or resistance welding technology.

BRIEF DESCRIPTION OF THE DRAWING

Further features and details of the present invention will be apparent from the specific description hereinafter. The drawing shows a sectional view of a spark plug according to the invention.

DETAILED DESCRIPTION OF THE INVENTION

FIG. 1 shows a sectional view of a spark plug according to the invention.

In the case of the spark plug according to the invention, recourse is had to a standard insulator body as is commercially used by various spark plug manufacturers.

That insulator body 1 (usually made from ceramic) is pushed into an upper spark plug housing portion 3, with the incorporation of a seal 2 at both sides. The lower portion 4 of the spark plug housing is also pushed onto the insulator body 1. In a further production step, the upper portion 3 and the lower portion 4 are preferably pressed together in the region of the insulator bead 15. In the pre-stressed condition the housing portions are welded together by means of laser at 5.

This method of construction means that the upper housing portion 3 can be designed to be highly stable in respect of pressure. That therefore prevents the insulator body 1 from being expelled under the effect of engine pressure. Due to the welding process in the contact region 5 of the upper housing portion 3 the housing components are permanently pre-stressed and sealing integrity is thus afforded between the upper and lower housing portions 3, 4—seal 2 and insulator body 1.

The materials for the upper and lower housing portions 3 and 4 can be weldable structural steels, high-quality steels and alloys thereof but also nickel-based alloys or brass alloys. The advantage of the brass housing lies in better heat dissipation.

The two-shell form adopted for the housing means that it is possible to produce a very compact high-pressure plug with a for example M18×1.5 screwthread 13.

A ground electrode carrier arrangement 6 can be mounted at the engine side on the lower housing portion 4. In the specific case, for reasons of temperature and resistance to hot corrosion, a ground electrode carrier arrangement 6 comprising Inco Alloy 600 (WNo 2.4816) is welded by means of laser to the housing in the region 7. As alternatives, it is also possible to use other nickel-based alloys or high-temperature high-quality steels. The ground electrode carrier arrangement 6 could possibly also be produced in one piece, that is to say as an integral component of the lower housing portion 4.

The design configuration of the ground electrode carrier arrangement 6 with 4 electrode fingers provides for good mixture accessibility.

The ground electrode carrier arrangement 6 is provided with precious metal plate portions (=ground electrodes 9), they are welded to the carrier 6 at one side or both sides by means of laser. The welding is such that the gap is closed at the electrode sides. In other words, between the precious metal plate portions and the electrode carrier fingers there is no open gap (or opening) through which gas can enter.

By virtue of this design configuration, it is possible to produce electrode burn-away edges which are very long, in relation to the compact overall component size. Precious metal plate portions 9 with an edge length of greater than 4.0 mm are fitted on the ground electrode carrier arrangement.

In the specific case the edge length of the ground electrode 9 is 6.25 mm.

In regard to the ground electrodes 9, the plug uses plate portions measuring 6.25×1.6×0.5 mm (it is also possible to adopt different dimensions). The precious metal used can be for example Pt Rh alloys (90/10, 95/5, 80/20, 75/25).

The welding processes used can be pulsed laser, continuously operating lasers (CW-lasers), electron beam welding processes or vacuum or high-vacuum brazing processes as well as plasma welding or resistance welding.

The base central electrode 12 of the insulator body 1 is welded to a central electrode carrier 10 in the region 11. The spark length can be established by means of the central electrode carrier 10, in matching relationship with the ground electrode carrier arrangement 6. The central electrode carrier 10 is pushed onto the base central electrode 12 until it bears flush against the insulator base 14. In that position it is welded to the base central electrode in the region 11. This arrangement means that the central electrode carrier 10 and the base central electrode 12 are high pressure-resistant. It is not possible for the base central electrode to be expelled from the insulator base, due to the engine pressure, as the central electrode carrier 10 which is welded to the base central electrode 12 is shoulder-supported at the insulator base 14. The weld join 11 between the electrode carrier and the electrode is produced by welding with a pulsed laser. It is however also possible to use a continuously operating laser (CW-laser), an electron beam welding process, a brazing process or resistance welding.

The weld 11 can be produced along the entire length of the base central electrode 12, in which case therefore welding is effected from the outside through the central electrode carrier 10 onto the base central electrode 12. It is possible to use one or more spot welds and one or more seam welds which on the longitudinal axis can be arranged if required at a plurality of locations at the periphery or radially if required at a plurality of locations at the periphery.

The central electrode carrier 10 is so designed that it permits good mixture accessibility. The design configuration according to the invention makes easy adjustment possible. The central electrode carrier is so designed that central electrodes 8 of a length of greater than 4 mm can be welded on. In the case of the specific invention, the edge length of the central electrode 8 is 6.25 mm. The central electrode carrier 10 is designed with 4 separate electrode fingers, onto which precious metal electrodes are welded as central electrodes 8.

The central electrode arrangement 10 is provided with precious metal plate portions as the central electrodes 8, they are welded to the carrier at one side or both sides by means of lasers. The welding is such that the gap is closed at the electrode sides. In other words, there is no open gap (or opening) through which gas can enter, between the precious metal plate portions and the electrode carrier fingers.

The central electrode carrier material used in the specific case is Inco Alloy 600 (WNo 2.4816). As alternatives thereto it is also possible to use other nickel-based alloys or high-temperature high-quality steels.

In regard to the central electrodes 8, the arrangement uses plate portions measuring 6.25×2.0×0.5 mm (it is also possible to use other dimensions). The precious metal used can be for example Pt Rh alloys (90/10, 95/5, 80/20, 75/25).

The invention claimed is:

1. A spark plug of an internal combustion engine, comprising an insulator body, at least one fixed ground electrode carrier arrangement and at least one fixed central electrode carrier, wherein a spark plug housing has at least an upper housing portion and a lower housing portion which enclose at least partly the insulator body, wherein at least the combustion chamber-side part of the insulator body is pressure-resistantly enclosed by the lower housing portion jointly with the upper housing portion and wherein the upper housing portion and the lower housing portion are welded to each other.

2. A spark plug as set forth in claim 1 wherein the upper housing portion and the lower housing portion are welded to each other by means of a laser.

3. A spark plug as set forth in claim 1 wherein the internal combustion engine is an Otto-cycle gas engine.

4. A spark plug as set forth in claim 1 wherein the insulator body is completely enclosed by the lower housing portion jointly with the upper housing portion.

5. A spark plug as set forth in claim 1 wherein the individual portions of the spark plug housing in their contact region are pushed over one another.

6. A spark plug as set forth in claim 1 wherein at least a part of the spark plug housing has a screwthread for screwing into a cylinder head.

7. A spark plug as set forth in claim 1 wherein the individual portions of the spark plug housing are made from electrically conductive material and the connections between the individual portions of the spark plug housing are adapted to be conductive in their respective contact region.

8. A spark plug as set forth in claim 1 wherein the individual portions of the spark plug housing each have at least one seal in relation to the insulator body.

9. A spark plug as set forth in claim 1 wherein the insulator body has at least one bead which extends over its entire periphery and which is arranged in a contact region of the upper housing portion and the lower housing portion.

10. A spark plug as set forth in claim 9 wherein the upper housing portion and the lower housing portion are welded to each other on the bead.

11. A spark plug as set forth in claim 1 wherein the ground electrode carrier arrangement is arranged on the spark plug housing and has at least one ground electrode.

12. A spark plug as set forth in claim 1 wherein the ground electrode carrier arrangement has four mutually perpendicularly arranged, flat, inwardly facing ground electrodes.

13. A spark plug as set forth in claim 1 wherein at least one ground electrode of the at least one ground electrode carrier arrangement is welded to the lower housing portion of the spark plug housing or is integrated into at least a portion of the spark plug housing.

14. A spark plug as set forth in claim 1 wherein at least one flat, outwardly facing central electrode, is arranged on the at least one fixed electrode carrier.

15. A spark plug as set forth in claim 1 wherein four mutually perpendicularly arranged, flat, outwardly facing central electrodes are arranged on the at least one fixed central electrode carrier.

16. A spark plug as set forth in claim 1 wherein the central electrode carrier and the ground electrode carrier arrangement each have at least one electrode and the electrodes of the central electrode carrier and the ground electrode carrier arrangement are respectively arranged in pairs in plane-parallel opposite relationship having an insulating air gap between each other.

17. A spark plug as set forth in claim 1 wherein the central electrode carrier is shouldered on the insulator body and surrounds the base central electrode and is completely welded to the base central electrode.

18. A spark plug as set forth in claim 1 wherein the edge length of central electrodes and ground electrodes is greater than 4 mm.

19. A spark plug as set forth in claim 1 wherein the edge length of central electrodes and ground electrodes is greater than 6 mm.

20. A spark plug as set forth in claim 1 wherein at least one portion of the spark plug housing is made from weldable structural steel or high-quality steel or an alloy thereof or nickel-based alloy or brass alloy.

21. A spark plug as set forth in claim 1 wherein the central electrode carrier or the ground electrode carrier arrangement is produced from Inco Alloy 600 (WNo 2.4816) or nickel-based alloy or high-temperature high-quality steels.

22. A spark plug as set forth in claim 1 wherein the central electrode carrier and the ground electrode carrier arrangement each have at least one electrode and the electrodes of the central electrode carrier and the ground electrode carrier arrangement have a coating of precious metal or precious metal plate portions.

23. A process for producing a spark plug as set forth in claim 1 wherein the individual portions of the spark plug housing are produced individually, pushed over a commercial standard insulator body and pushed one over the other and pressed or welded or pressed and welded to each other.

24. A process as set forth in claim 23 wherein the central electrode carrier is produced first, pushed flush onto a base central electrode of the insulator body as far as an insulator base and welded.

25. A process as set forth in claim 23 wherein the ground electrode carrier arrangement is welded to at least a portion of the spark plug housing or produced integrated into at least a portion of the spark plug housing.

26. A process as set forth in claim 23 wherein a pulsed or continuously operating laser welding process or electron beam welding process or plasma welding process or high-vacuum brazing process or resistance welding is used for the welding procedure.

* * * * *